United States Patent [19]

Fujikawa et al.

[11] 4,031,877

[45] June 28, 1977

[54] ENGINE LUBRICATING OIL PUMP

[75] Inventors: Tetsuzo Fujikawa, Kobe; Kichiji Misawa, Akashi, both of Japan

[73] Assignee: Kawasaki Jukogyo Kabushiki Kaisha, Kobe, Japan

[22] Filed: Feb. 19, 1976

[21] Appl. No.: 659,231

[30] Foreign Application Priority Data

Feb. 26, 1975 Japan ..... 50-27103

[52] U.S. Cl. ..... 123/195 A; 123/198 C; 123/196 R; 418/101

[51] Int. Cl.² ..... F02F 7/00

[58] Field of Search ..... 123/195 R, 195 A, 198 C, 123/196 R; 418/101

[56] References Cited

UNITED STATES PATENTS

| | | | |
|---|---|---|---|
| 1,913,199 | 6/1933 | Gosslau | 123/195 A |
| 2,568,473 | 9/1951 | Tucker | 123/195 A |

*Primary Examiner*—Clarence R. Gordon

[57] ABSTRACT

Air-cooled two stroke internal combustion engine having a cooling air blower driven by the engine and a lubricating oil pump for supplying lubricating oil to the engine, said lubricating oil pump being housed in the hub portion of the blower.

5 Claims, 4 Drawing Figures

ENGINE LUBRICATING OIL PUMP

The present invention relates to internal combustion engines having lubricating oil pump means. More particularly, the present invention relates to internal combustion engines having engine cooling blower means. Specifically, the present invention pertains to an installation of the oil pump means in such internal combustion engines.

Certain types of internal combustion engines, such as those of two stroke type usually have oil pump means for feeding lubricant oil to engine intake system at an amount which varies in accordance with engine operating conditions. Such oil pump means is usually disposed in the vicinity of engine crankcase and driven through a gear mechanism which derives driving power from the engine crankshaft. The gear mechanism as well as the oil pump is housed in a gear casing which presents a projecting or protruding portion on the crankcase. Thus, there is a possibility that the gear case interfers with installation of engine accessories such as a carburetor, exhaust pipe, exhaust noise attenuating device or the like. Further, such provision of gear casing will increase the weight of the engine crankcase.

Further disadvantage of the conventional arrangement is that, since the primary driving gear of the oil pump is mounted on or secured to the engine crankshaft, the length of the crankshaft must as a matter of course be increased. Still further, the gear case which is provided adjacent to the crankcase may receive heat from the crankcase so that the oil pump housed therein will have adverse thermal effects.

The present invention has therefore an object to eliminate the aforementioned disadvantage of the conventional oil pump arrangements.

Another object of the present invention is to provide internal combustion engines having novel mounting of oil pump means.

A futher object of the present invention is to provide internal combustion engines in which lubricating oil pump means is disposed in hub portion of engine cooling blower means.

Still further object of the present invention is to provide internal combustion engines in which lubricating oil pumps means is mounted apart from the engine crankcase.

According to the present invention, the above and other objects can be accomplished by an internal combustion engine comprising an engine portion having a power output member, cooling blower means driven by said power output member of the engine portion for producing flow of engine cooling air, said blower means having fairing means at hub portion thereof, lubricating oil pump means disposed in said fairing means of the blower means and driven by said power output member of the engine portion to provide supply of lubricating oil to the engine portion as the engine rotates. The oil pump means may be of plunger type and means may be provided for controlling the pump output in accordance with the engine operating conditions.

The above and other objects and features of the present invention will become apparent from the following descriptions of an embodiment taking reference to the accompanying drawings, in which.

Figure 1:
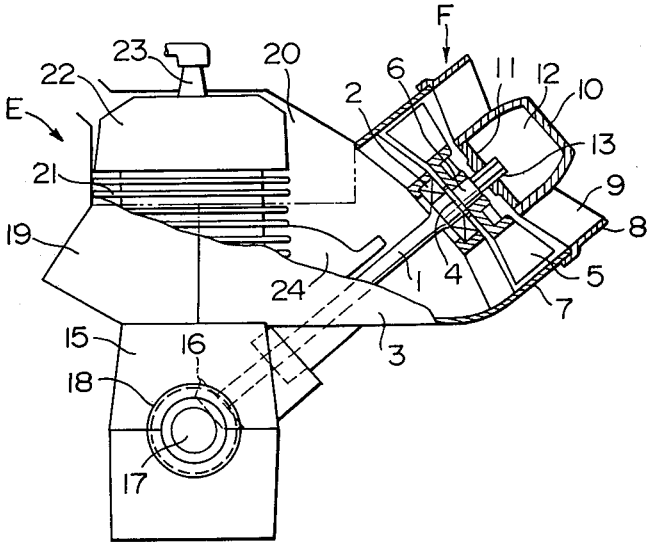
FIG. 1 is a partially cut-away side view of an internal combustion engine in which the present invention can be conveniently embodied.

Referring now to the drawings, particularly to FIG. 1, there is shown an internal combustion engine including an engine portion E and a cooling blower portion F. The engine portion comprises a crankcase 15, a cylinder 21 and a cylinder head 22 which carries an ignition plug 23 as in conventional engines, and a crankcase 17 is mounted in the crankcase 15. The crankshaft 17 has a bevel gear 18 mounted at one end thereof.

Figure 2:
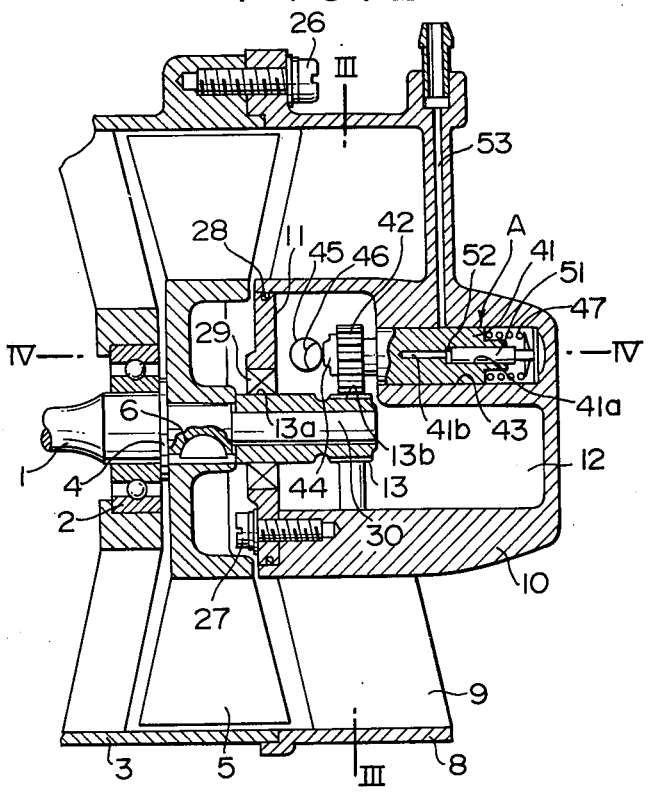
FIG. 2 is a sectional view of the hub portion of the cooling blower embodying the feature of the present invention.

The blower portion F comprises a blower shaft 1 having a bevel gear 16 at one end for meshing engagement with the bevel gear 18 on the crankshaft 17. At the other end of the crankshaft 1, a cooling fan 5 is mounted and secured in position by a key member 6. The blower F further includes a casing 3 having a cylindrical housing 7 which encloses the fan 5 and continues to a cooling air guide 19 covering the cylinder 21 and the cylinder head 22. The casing 3 further carries an end cover 8 having a radially extending stationary blades 9 and a central fairing 10 which covers the boss portion of the blower assembly. The end cover 8 is secured to the casing 3 by a suitable number of bolts 26. The fairing 10 is of a cup-shape and closed by a bottom plate 11 to define therein an interior space 12. As shown in FIG. 2, the bottom plate 11 is secured to the fairing 10 by means of bolts 27 and an O-ring seal 28 is disposed between the fairing 10 and the bottom plate 11.

According to the feature of the present invention, lubricating oil pumping mechanism is housed in the space 12. Referring to FIG. 2, the blower shaft 1 is journalled at the end adjacent to the fan 5 by a bearing 2 and has an annular flange 4 which engages at one side with the bearing 2 and at the other side with the fan 5 for positioning the fan. The shaft 1 further has an extended portion 30 of a reduced diameter and a worm member 13 is secured to the extended portion 30. The worm member 13 has a plain portion **13*a* which is supported by a bearing 29 on the bottom plate 11 and a worm portion 13*b*. As shown in FIG. 2, a lubricating oil pump assembly A is housed in the airing 10 of the blower assembly F. The pump assembly comprises a cylindrical bore 43 formed in the fairing 10 and a cylinder 41 rotatably and axially slidably received in the bore 43. The cylinder 41 has an axial bore 41*a* in which a plunger 51 is axially slidably received to define a pump chamber 52**.

Figure 3:
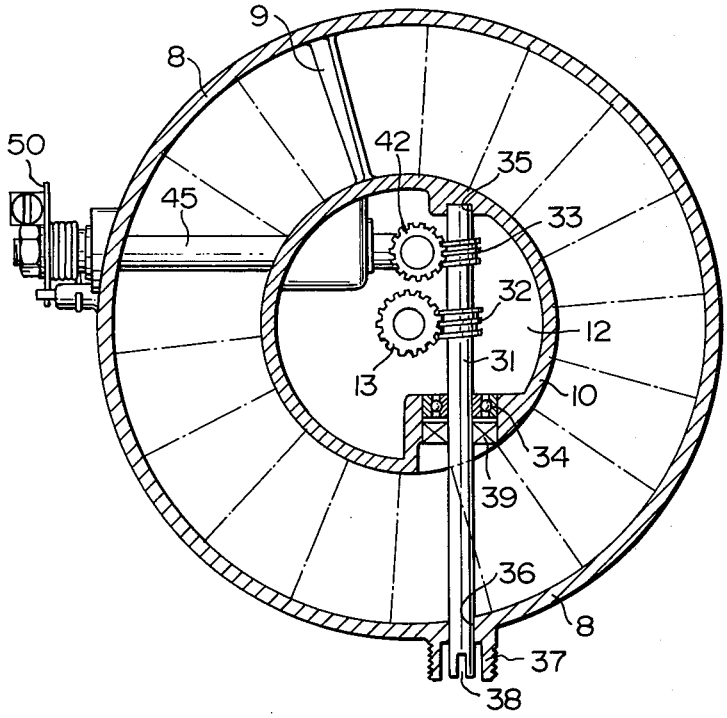
FIG. 3 is a sectional view taken substantially along the line III—III in FIG. 2.
Figure 4:
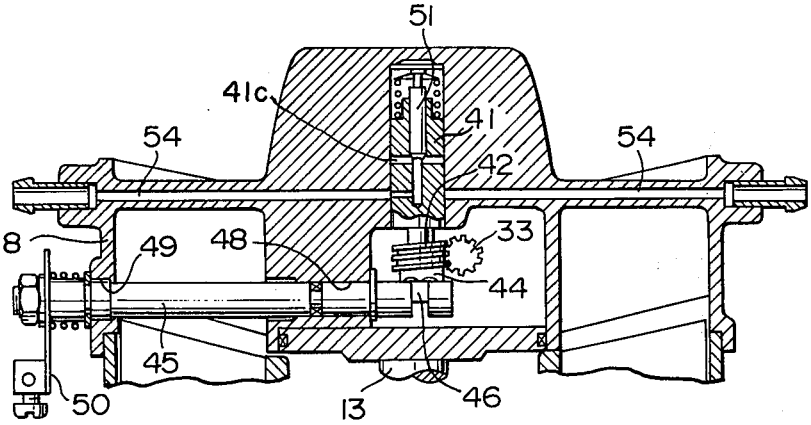
FIG. 4 is a sectional view taken substantially along the line IV—IV in FIG. 2.

As shown in FIGS. 3 and 4, a counter shaft 31 is mounted in the fairing 10 and extends through a bearing 34 and an oil seal 39 in the direction perpendicular to the shaft 1 and supported at its opposite ends by holes 35 and 36. The countershaft 31 has a worm wheel 32 which is in meshing engagement with the worm portion **13*a* on the member 13. The cylinder 41 is provided at a portion outside the bore 43 with a worm wheel 42 and at the end adjacent to the worm wheel 42 with an end cam 44. A stroke adjust shaft 45 is rotatably mounted in the fairing 10 at axially aligned bores 48 and 49 formed therein. The adjust shaft 45 has an inner end formed with a stroke adjusting cam 46 and an outer end connected to a stroke adjusting lever 50 which may in turn be connected to an engine through valve actuating lever or the like. A spring 47 is disposed in the bore 43 and acts on the cylinder 41 to force it so that the end cam 44 engages the stroke adjusting cam 46. The counter shaft 31 is further provided with a worm 33 which is in meshing engagement with the worm wheel 42 on the cylinder 41, whereby the rotation of the blower shaft 1 is transmitted through the worm portion 13***a*, the worm wheel 32, the counter shaft 31, the worm 33 and the worm wheel 42 to the cylinder 41 to effect rotation thereof. Since the end cam 44 is in engagement with the cam 46, the cylinder 41 conducts an axial reciprocating movement as it is rotated in the aforementioned manner. The stroke of the cylinder 41 can be adjusted by rotating the shaft 45.

The cylinder 41 is formed with an oil passage 41*b* which communicates with the pump chamber 52 and opens to the peripheral surface of the cylinder 41 at a port 41*c*. The fairing 10 is formed with an oil intake passage 53 and a pair of outlet or discharge passages 54 and the location of the port 41*c* is so determined that it communicates with the intake passage 53 when the cylinder 41 is displaced toward left as seen in FIG. 2 under the influence of the spring 47, and with the discharge passages 54 when the cylinder 41 is displaced in the opposite direction. Thus, as the fan 5 is driven by the engine crankshaft 17 through the shaft 1, the rotation is also transmitted to the cylinder 41 of the pump assembly A as previously described so as to rotatingly drive the cylinder 41. The rotation of the cylinder 1 then causes a reciprocating movement thereof through cooperation of the cams 44 and 46 so that oil is drawn through the intake passage 53 to the pump chamber 52 and discharged therefrom through the outlet passages 54. The oil thus pumped may be directed for example to crankshaft bearing mechanisms, piston sliding portions and/or other parts which require lubrication.

In the illustrated embodiment, the end casing 8 is formed with a socket portion 37 at a part from which the counter shaft 31 projects. The counter shaft 31 is further formed with a connector configuration 38 so that the engine rotation may be taken out therefrom to drive engine tachometer or the like accessories.

The invention has thus been shown and described with reference to a preferred embodiment, however, it should be noted that the invention is in no way limited to the details of the illustrated structures but changes and modifications may be made within the scope of the appended claims.

We claim:

1. Internal combustion engine comprising an engine portion having power output member, cooling blower means driven by said power output member of the engine portion for producing flow of engine cooling air, said blower means having fairing means at hub portion thereof, lubricating oil pump means disposed in said fairing means of the blower means and driven by said power output member of the engine portion to provide supply of lubricating oil to the engine portion as the engine rotates.

2. Internal combustion engine in accordance with claim 1 in which said lubricating oil pump means is of a plunger type.

3. Internal combustion engine in accordance with claim 2 in which said pump means include means for adjusting pump stroke to change amount of output in each pumping cycle.

4. Internal combustion engine in accordance with claim 1 in which said blower means includes a fan having a driving shaft which is connected with the engine power output member and said oil pump means is drivingly connected with the driving shaft to be driven thereby.

5. Internal combustion engine in accordance with claim 1 in which said blower means includes a casing which stationarily carries said fairing means in which said oil pump means is housed.

* * * * *